US011795870B2

(12) United States Patent
Matsue et al.

(10) Patent No.: US 11,795,870 B2
(45) Date of Patent: Oct. 24, 2023

(54) OUTBOARD MOTOR, INTERNAL COMBUSTION ENGINE, AND MARINE VESSEL

(71) Applicant: YAMAHA HATSUDOKI KABUSHIKI KAISHA, Iwata (JP)

(72) Inventors: Hiroto Matsue, Shizuoka (JP); Shinya Maekawa, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days.

(21) Appl. No.: 17/955,791

(22) Filed: Sep. 29, 2022

(65) Prior Publication Data

US 2023/0151763 A1 May 18, 2023

(30) Foreign Application Priority Data

Nov. 16, 2021 (JP) ..... 2021-186428

(51) Int. Cl.

| | |
|---|---|
| ***F02B 61/04*** | (2006.01) |
| ***F02B 75/00*** | (2006.01) |
| ***F01M 13/00*** | (2006.01) |
| ***B63H 20/32*** | (2006.01) |

(52) U.S. Cl.

CPC ..... *F02B 61/045* (2013.01); *B63H 20/32* (2013.01); *F01M 13/00* (2013.01); *F02B 75/007* (2013.01); *F01M 2013/0038* (2013.01)

(58) Field of Classification Search

CPC ..... F02B 61/045; F02B 75/007; F01M 13/00; F01M 2013/0038; F01M 13/04; B63H 20/32

See application file for complete search history.

(56) References Cited

U.S. PATENT DOCUMENTS

| | | | | |
|---|---|---|---|---|
| 5,794,602 | A | 8/1998 | Kimura | |
| 6,367,441 | B1 * | 4/2002 | Hoshiba | F01M 11/02 123/196 R |
| 2002/0040706 | A1 | 4/2002 | Katayama et al. | |
| 2007/0240692 | A1 * | 10/2007 | Takahashi | F02B 61/045 123/196 R |
| 2015/0133007 | A1 * | 5/2015 | Saruwatari | F01M 11/0004 440/88 L |
| 2020/0283115 | A1 * | 9/2020 | Fulker | B63H 20/32 |

FOREIGN PATENT DOCUMENTS

| | | | |
|---|---|---|---|
| JP | 2001-065412 | A | 3/2001 |
| JP | 3537554 | B2 | 6/2004 |
| JP | 3805505 | B2 * | 8/2006 |
| JP | 2008-255816 | A | 10/2008 |

* cited by examiner

*Primary Examiner* — Syed O Hasan

(74) *Attorney, Agent, or Firm* — KEATING AND BENNETT, LLP

(57) ABSTRACT

An outboard motor to be attached to a hull of a marine vessel that reduces an amount of oil in blow-by gas reaching a breather chamber includes an internal combustion engine including a cylinder block including at least one cylinder. The cylinder block includes two blow-by gas flow paths to guide blow-by gas from a crank chamber to a breather chamber, and the internal combustion engine is oriented such that a crankshaft extends along a direction perpendicular or substantially perpendicular to a bottom of the hull when the marine vessel is sailing.

10 Claims, 10 Drawing Sheets

OUTBOARD MOTOR, INTERNAL COMBUSTION ENGINE, AND MARINE VESSEL

CROSS REFERENCE TO RELATED APPLICATIONS

This application claims the benefit of Japanese Patent Application No. 2021-186428, filed Nov. 16, 2021, which is hereby incorporated by reference herein in its entirety.

BACKGROUND OF THE INVENTION

1. Field of the Invention

The present invention relates to an outboard motor, an internal combustion engine, and a marine vessel.

2. Description of the Related Art

Blow-by gas generated in an internal combustion engine of an outboard motor entrains oil mist in a crank chamber of the internal combustion engine. The blow-by gas is once introduced into a breather chamber having a gas-liquid separation function to separate the oil, and then is fed into an intake port of the internal combustion engine to be combusted. Usually, the blow-by gas is introduced into the breather chamber via one blow-by gas flow path provided in a cylinder block (see, e.g., Japanese Patent No. 3537554).

In recent years, a marine vessel is required to more quickly reach a destination, and an increase in the output of the outboard motor therefor has been studied. When the output increases, for example, a combustion pressure increases to cause the blow-by gas to increase in the internal combustion engine, such that the amount of the oil taken out from the crank chamber by the blow-by gas also increases. Therefore, the breather chamber for separating the oil from the blow-by gas also needs to be enlarged.

However, the entire surface of the internal combustion engine of the outboard motor is covered with a cowl, and there is not much room in the layout thereof, which limits the size of the breather chamber. Therefore, the amount of the oil that can be separated from the blow-by gas in the breather chamber is also limited. Therefore, it is necessary to reduce the amount of the oil contained in the blow-by gas reaching the breather chamber as much as possible.

SUMMARY OF THE INVENTION

Preferred embodiments of the present invention reduce an amount of oil in blow-by gas reaching a breather chamber.

According to a preferred embodiment of the present invention, an outboard motor to be attached to a hull of a marine vessel includes an internal combustion engine including a cylinder block including at least one cylinder, wherein the cylinder block includes two blow-by gas flow paths to guide blow-by gas from a crank chamber to a breather chamber, and the internal combustion engine is oriented such that a crankshaft extends along a direction perpendicular or substantially perpendicular to a bottom of the hull when the marine vessel is sailing. Further, according to another preferred embodiment of the present invention, an internal combustion engine to be attached to a hull of a marine vessel includes a cylinder block including at least one cylinder, wherein the cylinder block includes two blow-by gas flow paths to guide blow-by gas from a crank chamber to a breather chamber.

According to the above configuration, the cylinder block includes the two blow-by gas flow paths such that a total cross-sectional area of the blow-by gas flow paths is increased. As a result, a flow velocity of the blow-by gas flowing through each of the blow-by gas flow paths is reduced, and a period of time for the blow-by gas to reach the breather chamber from the crank chamber is increased. That is, a period of time to separate the oil from the blow-by gas in each of the blow-by gas flow paths is sufficiently secured. As a result, an amount of the oil in the blow-by gas reaching the breather chamber is reduced.

The above and other elements, features, steps, characteristics and advantages of the present invention will become more apparent from the following detailed description of the preferred embodiments with reference to the attached drawings.

DESCRIPTION OF THE EMBODIMENTS

Figure 1:
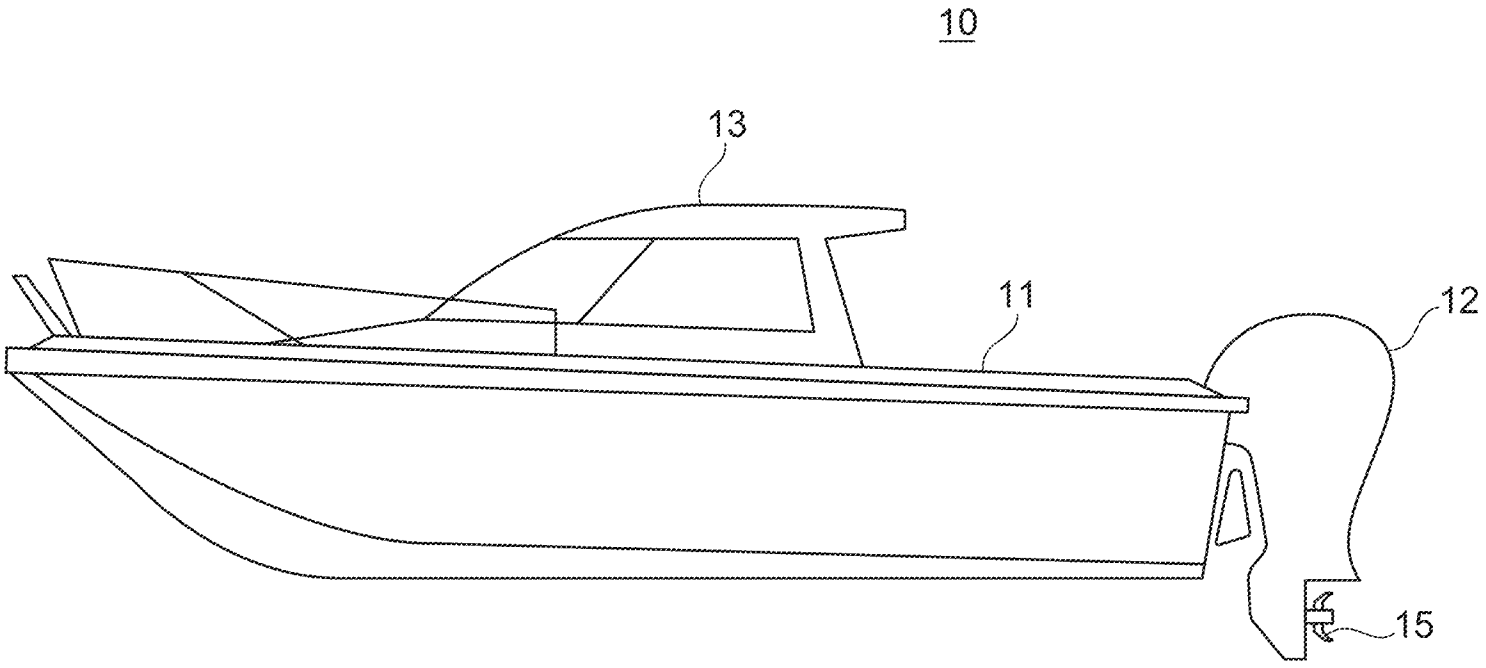
FIG. 1 is a side view of a marine vessel to which an outboard motor according to a preferred embodiment of the present invention is applied.
Figure 2:
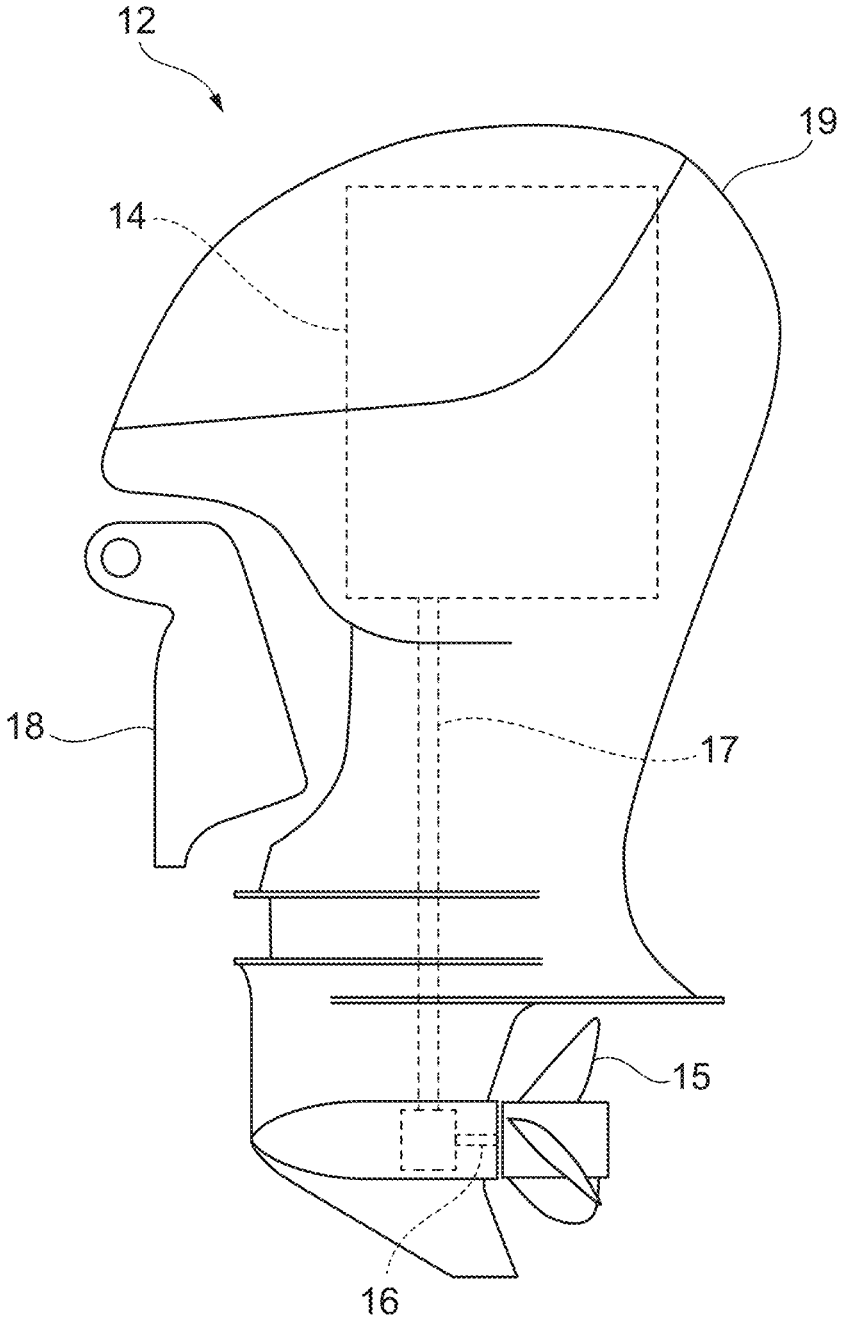
FIG. 2 is a side view schematically showing a configuration of the outboard motor according to a preferred embodiment of the present invention.

Hereinafter, preferred embodiments of the present invention will be described with reference to the drawings. FIG. 1 is a side view of a marine vessel 10 to which an outboard motor 12 according to a preferred embodiment of the present invention is applied, and FIG. 2 is a side view schematically showing the configuration of the outboard motor 12 according to a preferred embodiment of the present invention.

The marine vessel 10 is a planing boat, and includes a hull 11 and at least one, e.g., two outboard motors 12 as a propulsion device attached to the stern of the hull 11. A cabin 13 also functioning as a cockpit is provided in the hull 11. The outboard motor 12 includes an internal combustion engine 14, a propeller 15, a propeller shaft 16 to rotate the propeller 15, and a drive shaft 17 to transmit the driving force of the engine 14 to the propeller shaft 16. The outboard motor 12 applies a thrust to the marine vessel 10 by the propeller 15 being rotated by the driving force of the engine 14.

The outboard motor 12 includes a steering mechanism (not shown). The steering mechanism adjusts the direction of action of the thrust generated by the outboard motor 12 by swinging the outboard motor 12 horizontally or substantially horizontally with respect to the hull 11. The outboard motor 12 further includes a suspension mechanism 18 to attach the outboard motor 12 to the stern of the hull 11. The suspension mechanism 18 functions as a lifting mechanism for the outboard motor 12, and tilts up the outboard motor 12 when the marine vessel 10 is stored.

A large amount of water droplets are sprayed on the outboard motor 12. The outboard motor 12 includes a cowl 19 that covers the entire surface of the engine 14 so that each component of the engine 14 is not corroded by salt water or the like. The cowl 19 covers the propeller shaft 16 and the drive shaft 17 in addition to the engine 14.

In the outboard motor 12, the engine 14 is oriented such that the axial direction of the drive shaft 17 or a crankshaft 28 to be described below is perpendicular or substantially perpendicular to the bottom of the hull 11 when the marine vessel 10 is sailing.

Figure 3:
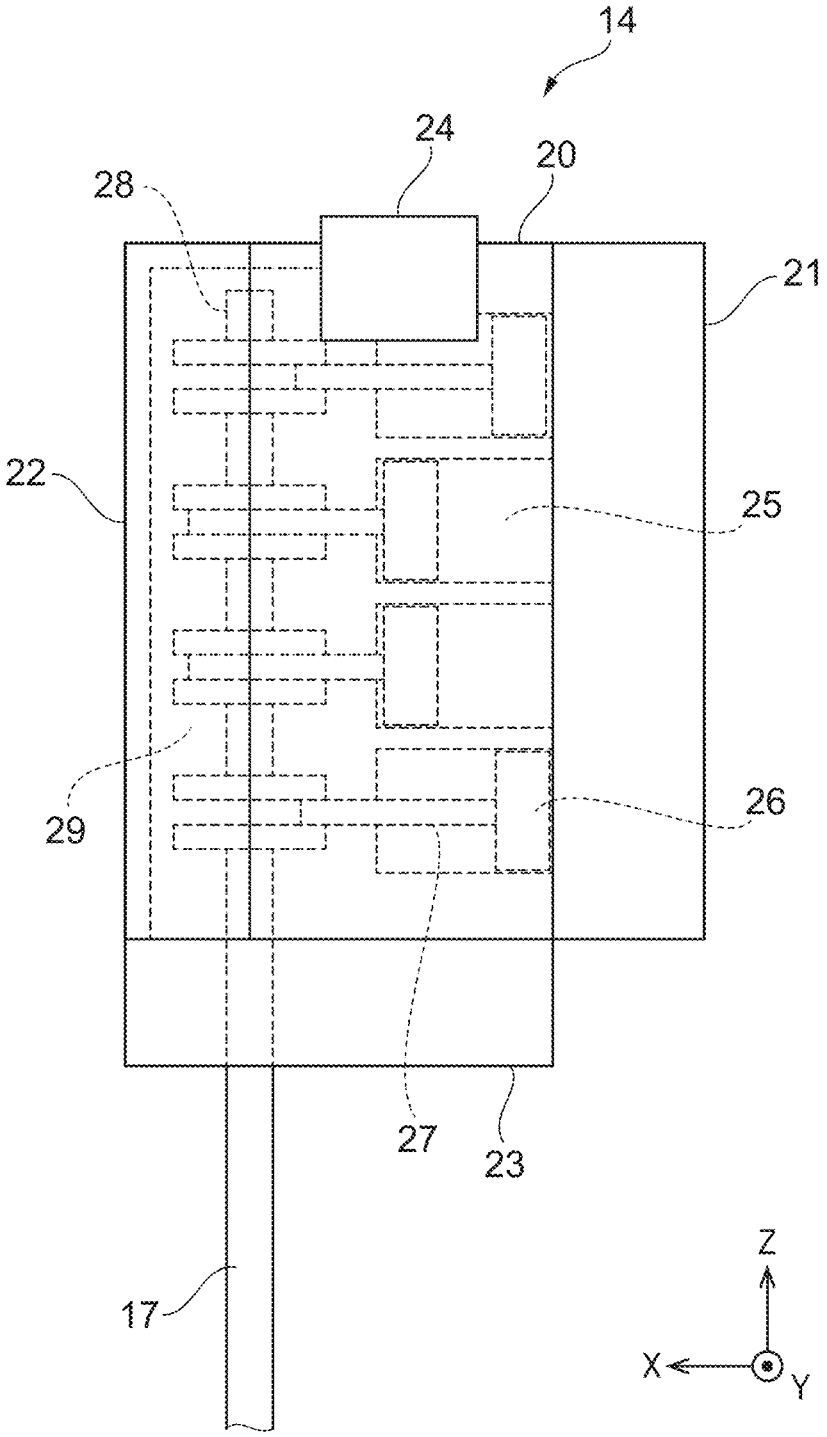
FIG. 3 is a side view schematically showing a configuration of an engine.

FIG. 3 is a side view schematically showing the configuration of the engine 14. In FIG. 3, the engine 14 includes a cylinder block 20, a cylinder head 21, a crankcase 22, an oil pan 23, and a breather chamber 24, as main components.

Note that a vertical direction in FIG. 3 is a direction perpendicular or substantially perpendicular to the bottom of the hull 11 of the marine vessel 10. The vertical direction is, for example, a direction perpendicular or substantially perpendicular to flat land when the marine vessel 10 is on land, and is also a direction perpendicular or substantially perpendicular to a water surface when the marine vessel 10 is stopped and floating on the water surface. In the drawings of the present preferred embodiment, hereinafter, a direction from the stern of hull 11 toward the bow thereof (that is, the traveling direction of the marine vessel 10) is represented by "+X", a direction from the starboard side of the hull 11 toward the port side thereof is represented by "+Y", and a direction from the bottom of the hull 11 (outboard motor 12) toward the top thereof is represented by "+Z". The port side (the front side in FIG. 3) (+Y side) of the hull 11 is referred to as an exhaust side, and the starboard side (the side opposite to the front side in FIG. 3) (−Y side) of the hull 11 is referred to as an intake side.

The cylinder block 20 includes a plurality of, for example, four cylinders 25 arranged on a straight line, wherein a piston 26 is inserted into each of the cylinders 25. Each of the pistons 26 is connected to a crankshaft 28 by a connecting rod 27. The cylinder head 21 includes combustion chambers (not shown) corresponding to each of the cylinders 25 of the cylinder block 20, and is fastened to the cylinder block 20 such that each of the combustion chambers faces each of the cylinders 25. The crankcase 22 is fastened to the cylinder block 20 so as to face the cylinder head 21 with the cylinder block 20 interposed therebetween. The crankcase 22 and the cylinder block 20 sandwich the crankshaft 28 therebetween, and further define a crank chamber 29 accommodating the crankshaft 28. One end of the crankshaft 28 is connected to the drive shaft 17. The crankshaft 28 is pivotally supported by a journal bearing (not shown) provided in the cylinder block 20 and the crankcase 22 so as to be coaxial with the drive shaft 17.

The oil pan 23 covers the lower surfaces of the cylinder block 20 and the crankcase 22, and stores lubricating oil therein. The inside of the oil pan 23 communicates with the crank chamber 29. The oil in the oil pan 23 is pressure-fed to each component of the engine 14 by an oil pump (not shown) via a strainer (not shown), and lubricates mainly sliding components. The oil used to lubricate each of the components is discharged to, for example, the crank chamber 29 and then falls to the oil pan 23. At this time, a portion of the oil in the oil pan 23 floats in a mist state. The breather chamber 24 is attached to the cylinder block 20. However, the breather chamber 24 may be integral with the cylinder block 20 instead.

The engine 14 causes the crankshaft 28 to convert the moving force of each of the pistons 26 due to the pressure of combustion generated in the combustion chamber of the cylinder head 21 into a rotational force, and transmits the rotational force to the drive shaft 17. In the engine 14, as described above, the crank chamber 29 communicates with the inside of the oil pan 23. Therefore, blow-by gas that has passed through the gap between the piston 26 and the wall surface of the cylinder 25 from the combustion chamber and entered the crank chamber 29 further enters the oil pan 23. The blow-by gas entrains mist oil floating inside the oil pan 23. The blow-by gas entraining the oil is introduced into the breather chamber 24 through two blow-by gas flow paths 30 and 31 described below.

Figure 4:
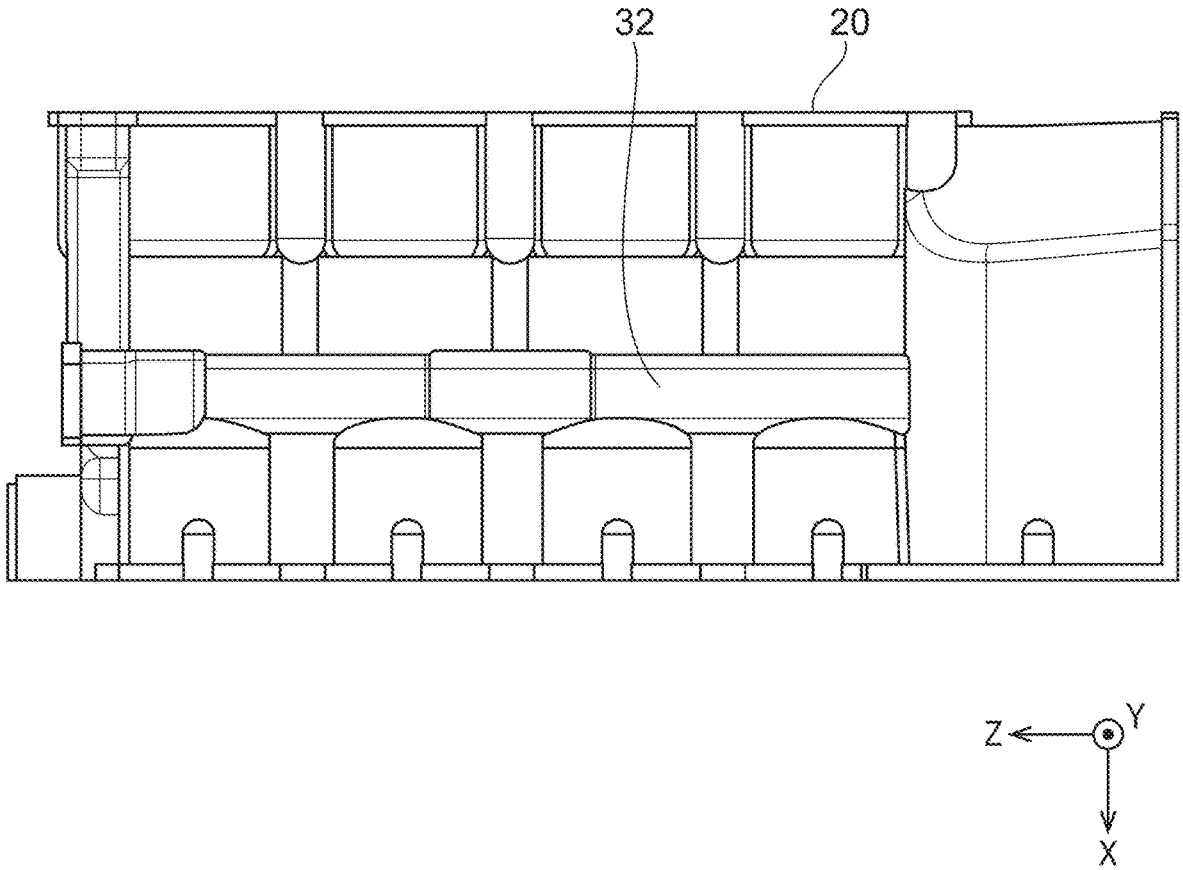
FIG. 4 is a side view of a cylinder block as viewed from an exhaust side.
Figure 5:
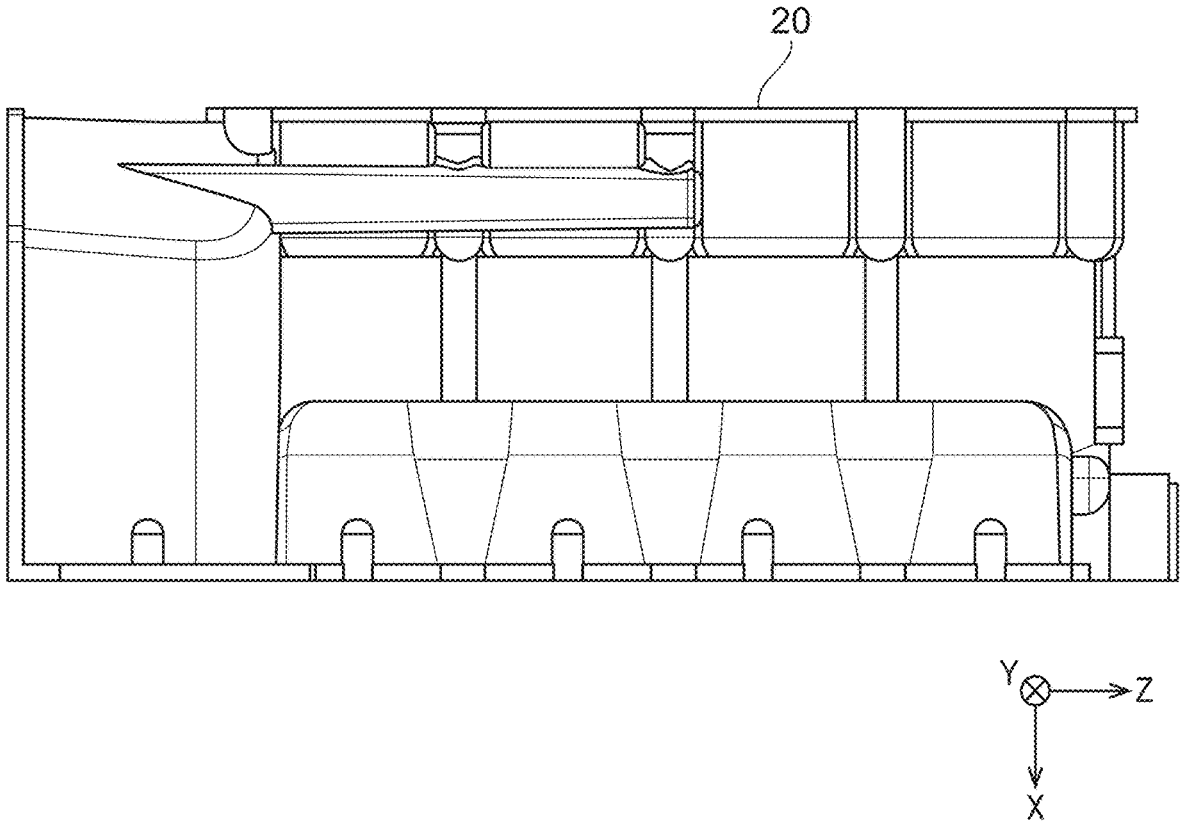
FIG. 5 is a side view of the cylinder block as viewed from an intake side.
Figure 6:
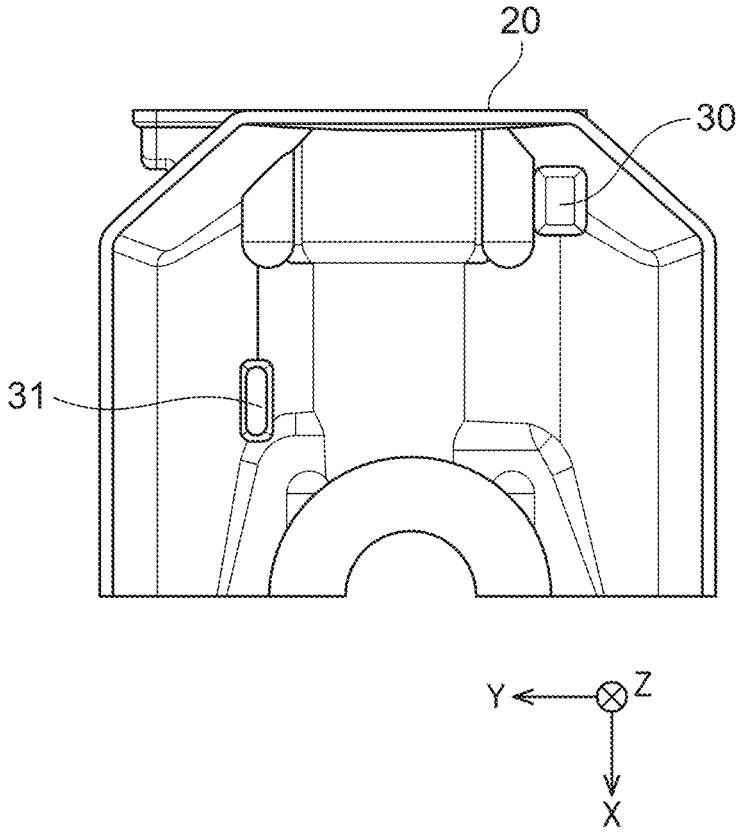
FIG. 6 is a front view of the cylinder block as viewed from an oil pan side.
Figure 7:
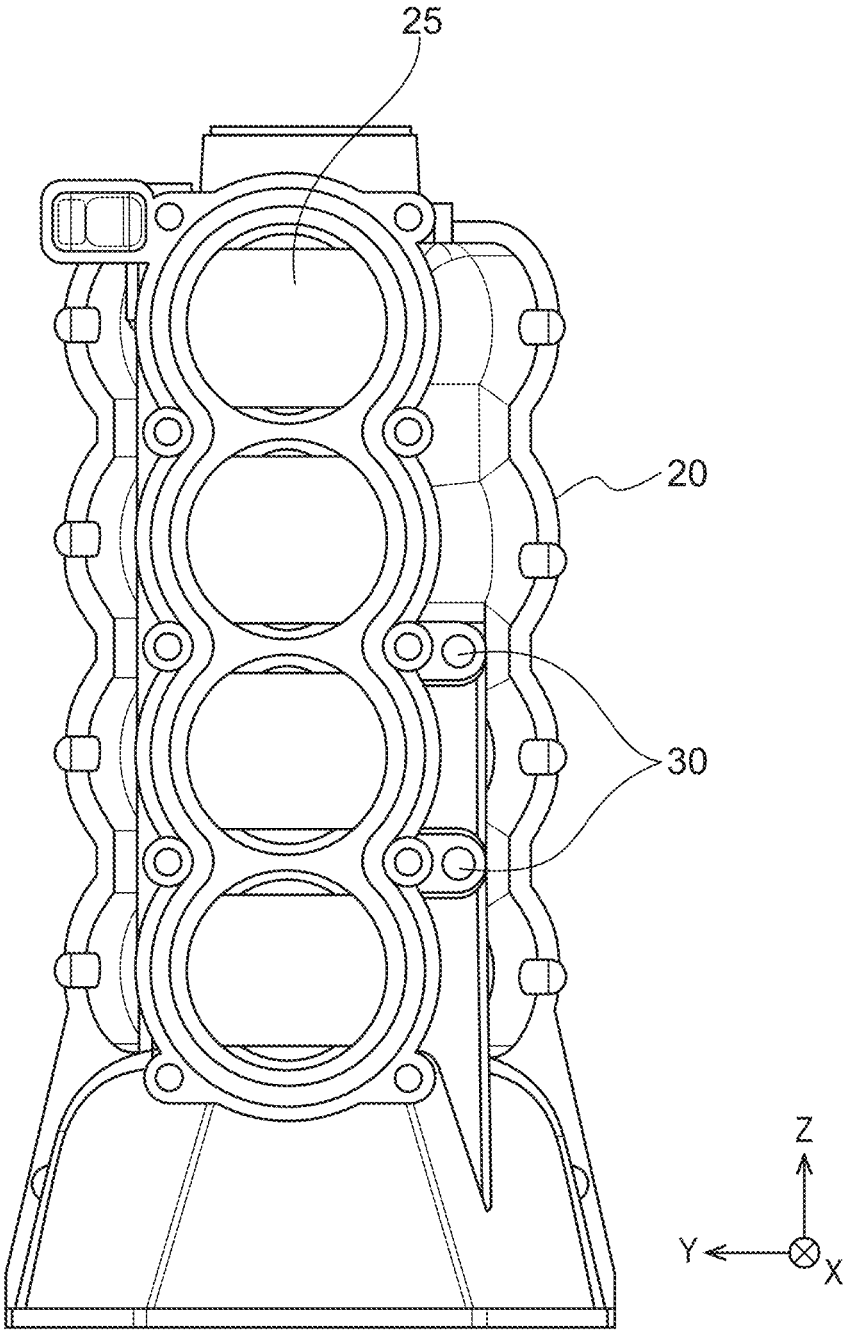
FIG. 7 is a plan view of the cylinder block as viewed from a cylinder head side.
Figure 8:
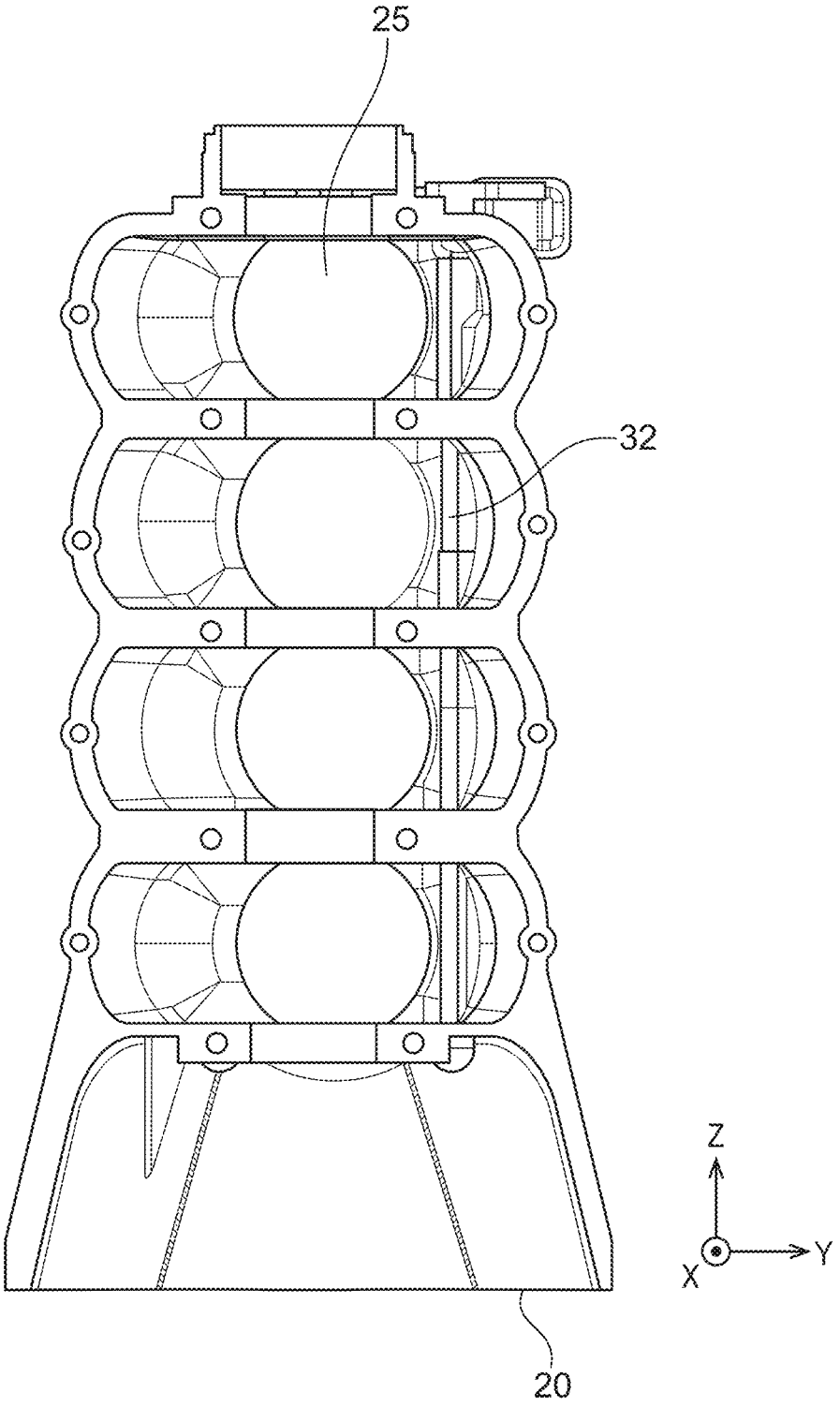
FIG. 8 is a bottom view of the cylinder block as viewed from a crankcase side.
Figure 9:
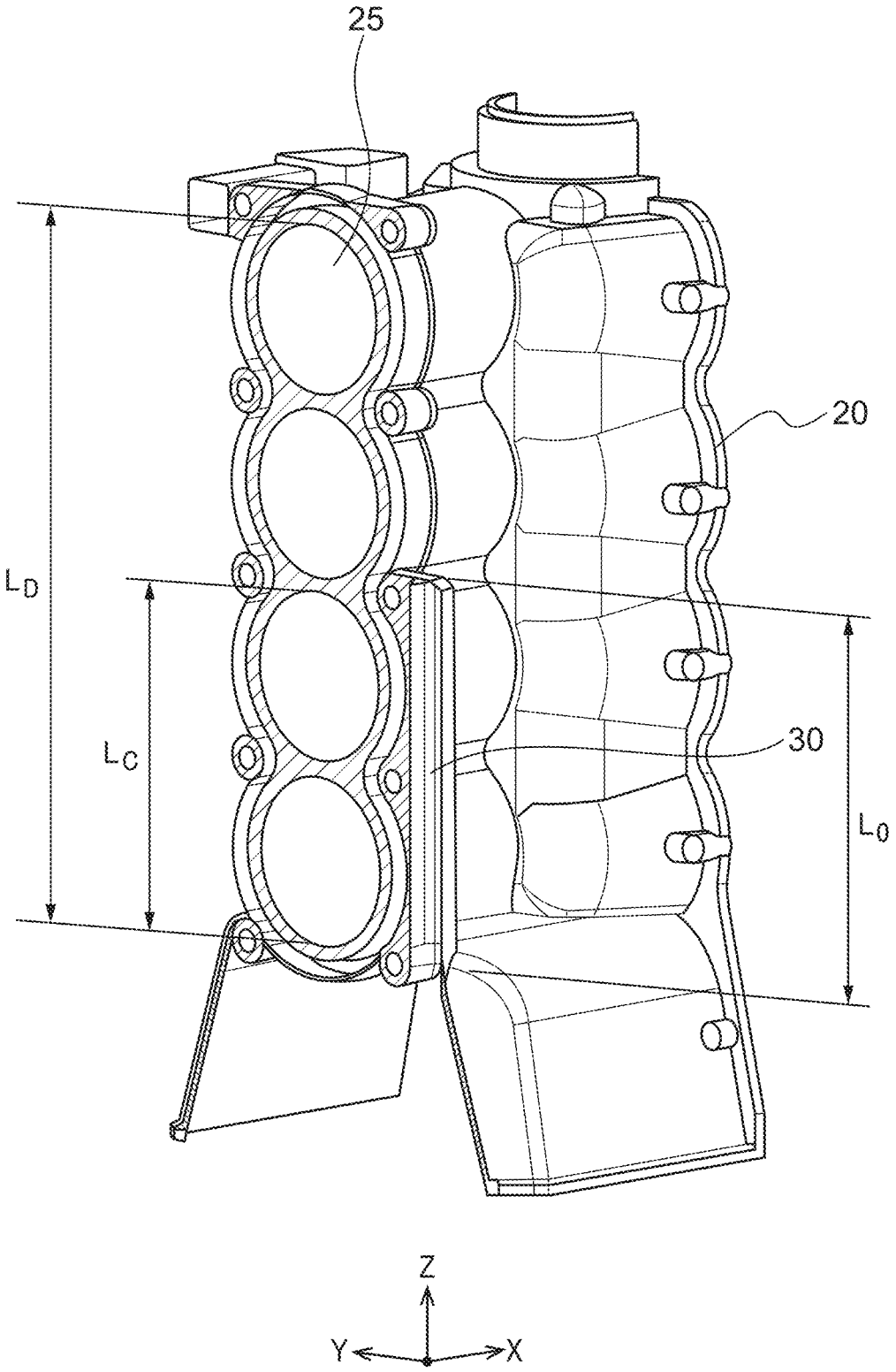
FIG. 9 is a horizontal cross-sectional view for explaining an arrangement of blow-by gas flow paths provided on the intake side of the cylinder block.
Figure 10:
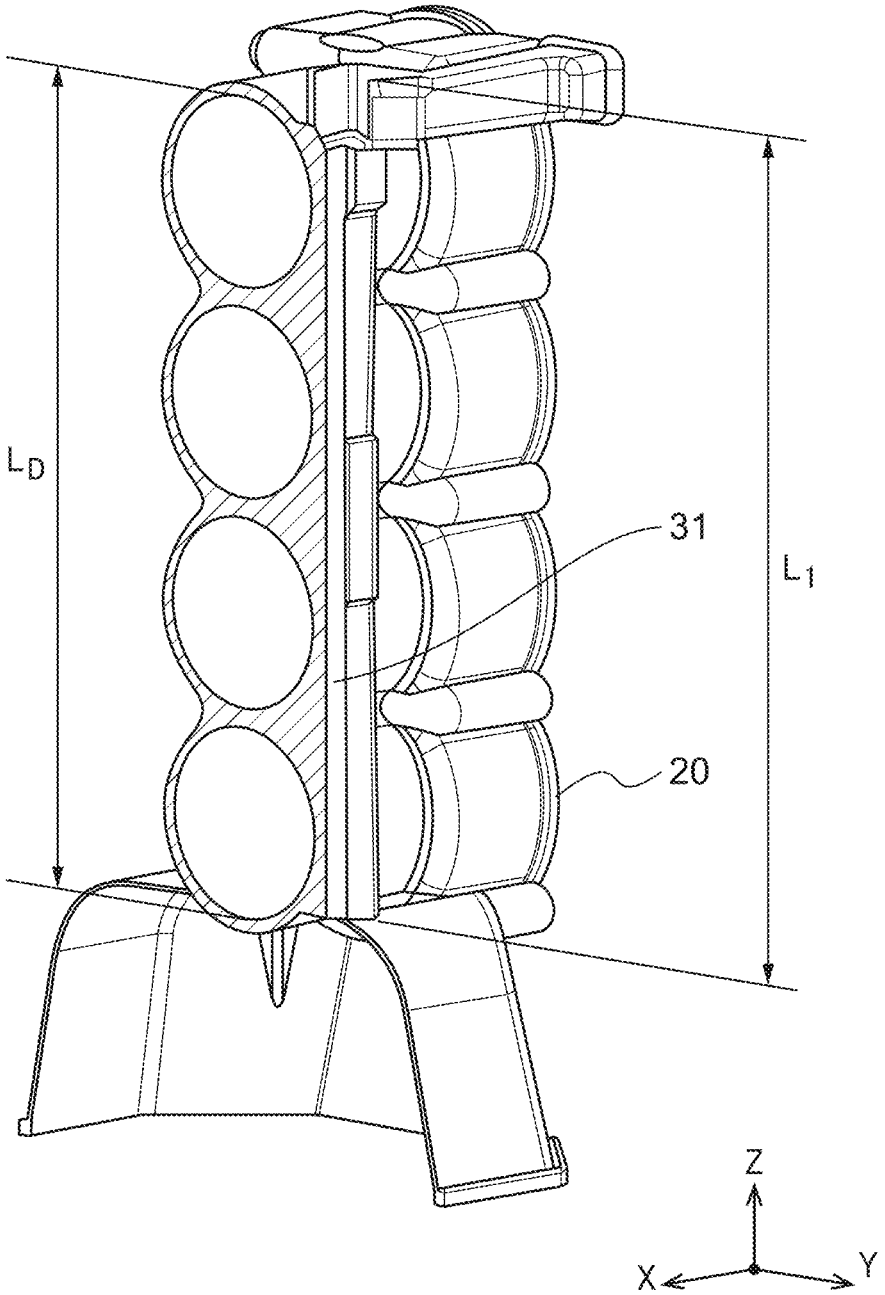
FIG. 10 is a horizontal cross-sectional view for explaining an arrangement of blow-by gas flow paths provided on the exhaust side of the cylinder block.

Next, the two blow-by gas flow paths 30 and 31 included in the cylinder block 20 in the present preferred embodiment will be described. Regarding a viewed angle of the cylinder block 20, its front view is defined by FIG. 6. FIG. 4 is a side view of the cylinder block 20 as viewed from an exhaust side, and FIG. 5 is a side view of the cylinder block 20 as viewed from an intake side. FIG. 6 is a front view of the cylinder block 20 as viewed from an oil pan 23 side, FIG. 7 is a plan view of the cylinder block 20 as viewed from a cylinder head 21 side, and FIG. 8 is a bottom view of the cylinder block 20 as viewed from a crankcase 22 side. FIG. 9 is a horizontal cross-sectional view for explaining the arrangement of the blow-by gas flow path 30 on the intake side of the cylinder block 20, and FIG. 10 is a horizontal cross-sectional view for explaining the arrangement of the blow-by gas flow path 31 on the exhaust side of the cylinder block 20.

The cylinder block 20 includes the two blow-by gas flow paths 30 and 31. The cylinder block 20 is manufactured by a die casting method using aluminum, for example. The shape of each of the blow-by gas flow paths 30 and 31 is mainly formed by a die casting mold.

The blow-by gas flow path 30 is on the intake side of the cylinder block 20, and the blow-by gas flow path 31 is on the exhaust side of the cylinder block 20. The blow-by gas flow path 30 and the blow-by gas flow path 31 sandwich the plurality of cylinders 25 therebetween.

Each of the blow-by gas flow paths 30 and 31 extends along the arrangement direction (hereinafter, referred to as a "cylinder arrangement direction") of the plurality of cylinders 25 oriented along a single straight line in the cylinder block 20. The cylinder arrangement direction is parallel or substantially parallel to a Z direction in the drawing. The cylinder arrangement direction is also parallel or substantially parallel to the axial direction of the crankshaft 28, that is, the blow-by gas flow paths 30 and 31 extend parallel or substantially parallel to the axial direction of the crankshaft 28.

As shown in FIG. 9, the length Lo of the blow-by gas flow path 30 along the cylinder arrangement direction is greater than a length $L_C$ of the front end to the rear end of two cylinders 25 in the cylinder arrangement direction. As shown in FIG. 10, the blow-by gas flow path 31 penetrates the cylinder block 20 in the Z direction in the drawing. That is, the length Li of the blow-by gas flow path 31 is greater than a length $L_D$ of the front end to the rear end of four cylinders 25 in the cylinder arrangement direction. In other words, the height of the blow-by gas flow path 30 is twice or more than the diameter of a cylinder 25, and the height of the blow-by gas flow path 31 is four times or more than the diameter of a cylinder 25. In the present preferred embodiment, the length Lo of the blow-by gas flow path 30 is shorter than the length Li of the blow-by gas flow path 31. However, the length Lo and the length Li may be equal or substantially equal to each other. The Z direction in the drawing is the vertical direction of the hull 11, that is, the extending direction of the blow-by gas flow paths 30 and 31 coincides with the direction of gravity.

One end of each of the blow-by gas flow paths 30 and 31 is open to the attachment surface for the oil pan 23 in the cylinder block 20 (the front surface of the cylinder block 20) (FIG. 6). As a result, the blow-by gas inside the oil pan 23 efficiently flows into the blow-by gas flow paths 30 and 31.

The other end of the blow-by gas flow path 30 is open to the attachment surface (the upper surface of the cylinder block 20) for the cylinder head 21 in the cylinder block 20 (FIG. 7). The blow-by gas flowing through the blow-by gas flow path 30 flows into a blow-by gas flow path (not shown) provided in the cylinder block 20 from an opening in the upper surface of the cylinder block 20, and then flows into the breather chamber 24. The other end of the blow-by gas flow path 31 is open to the surface of the cylinder block 20 opposite to the attachment surface for the oil pan 23 (the back surface of the cylinder block 20). The blow-by gas flowing through the blow-by gas flow path 31 flows into the breather chamber 24 from the opening in the back surface of the cylinder block 20 through a pipe or the like (not shown).

It takes a period of time for the blow-by gas which has flowed into the blow-by gas flow paths 30 and 31 to flow into the breather chamber 24, to some extent. On the other hand, the separation of the oil from the blow-by gas proceeds over a period of time. While the blow-by gas flows through the blow-by gas flow paths 30 and 31, the separation of the oil from the blow-by gas proceeds. That is, the blow-by gas flow paths 30 and 31 secondarily have a gas-liquid separation function. The oil separated from the blow-by gas in the blow-by gas flow paths 30 and 31 falls toward the oil pan 23 in the blow-by gas flow paths 30 and 31.

In a preferred embodiment of the present invention, the cylinder block 20 of the engine 14 includes the two blow-by gas flow paths 30 and 31 such that the total cross-sectional area of the blow-by gas flow paths is increased. As a result, the flow velocity of the blow-by gas flowing through each of the blow-by gas flow paths 30 and 31 is reduced, and a period of time for the blow-by gas to reach the breather chamber 24 from the oil pan 23 is increased. That is, a period of time to separate the oil from the blow-by gas in each of the blow-by gas flow paths 30 and 31 is sufficiently secured. As a result, the amount of the oil in the blow-by gas reaching the breather chamber 24 is reduced.

In a preferred embodiment of the present invention, both the blow-by gas flow paths 30 and 31 are arranged to provide only a necessary minimum wall thickness between each of the blow-by gas flow paths and the cylinders 25. That is, both the blow-by gas flow paths 30 and 31 are close to the cylinders 25. As a result, it is possible to reduce a cylindrical thick portion (boss) surrounding the blow-by gas flow paths 30 and 31 from sticking out from the outer surface of the cylinder block 20. In particular, in a preferred embodiment of the present invention, as a result of the blow-by gas flow path 31 being close to the cylinders 25 as much as possible, a portion of the boss 32 surrounding the blow-by gas flow path 31 protrudes into the crank chamber 29 (FIG. 8). As a result, it is possible to prevent the cylinder block 20 from becoming unnecessarily large, which makes it possible to help miniaturize and reduce the weight of the engine 14, and thus the outboard motor 12.

Furthermore, in a preferred embodiment of the present invention, in order to increase the cross-sectional area of the blow-by gas flow path, the number of the blow-by gas flow paths is increased instead of increasing the cross-sectional area of each blow-by gas flow path. This not only prevents the boss surrounding the blow-by gas flow paths from unnecessarily sticking out from the surface of the cylinder block 20, but also eliminates the need to increase the cross-sectional area of each of the blow-by gas flow paths so that the degree of freedom in the arrangement of the blow-by gas flow paths increases. As a result, the influence of the increase in the cross-sectional area of the blow-by gas flow path on the shape of the cylinder block 20 is reduced or minimized.

As a result of providing both the blow-by gas flow paths 30 and 31 close to the cylinders 25, each of the blow-by gas flow paths 30 and 31 is close to a water jacket (not shown) for cooling the cylinder 25. For example, a portion of the boss surrounding the blow-by gas flow path 30 and/or a portion of the boss 32 surrounding the blow-by gas flow path 31 is exposed to the water jacket. As a result, the blow-by gas flowing through each of the blow-by gas flow paths 30 and 31 is efficiently cooled, and the separation of the oil from the blow-by gas in each of the blow-by gas flow paths 30 and 31 is increased.

Furthermore, in a preferred embodiment of the present invention, as described above, the height of the blow-by gas flow path 30 is twice or more than the diameter of a cylinder 25, and the height of the blow-by gas flow path 31 is four times or more than the diameter of a cylinder 25. In this manner, a sufficient height of the flow path is provided, which makes it possible to provide an increased period of time during which the blow-by gas stays in each of the blow-by gas flow paths 30 and 31. This makes it possible to further secure a period of time to separate the oil from the blow-by gas in each of the blow-by gas flow paths 30 and 31. The extending direction of the blow-by gas flow paths 30 and 31 coincides with the direction of gravity such that the separated oil is actively dropped toward the oil pan 23. As a result, the separation of the oil from the blow-by gas is increased.

Although preferred embodiments of the present invention have been described above, the present invention is not limited to the above-described preferred embodiments, and various modifications and changes can be made within the scope of the gist of the present invention.

For example, in the above-described preferred embodiments, the blow-by gas flow path 31 penetrates the cylinder block 20 in a straight line in the Z direction. However, a crank shape may be provided in the middle of the blow-by gas flow path 31. In this case, it can be expected that the resistance of the flow path increases due to the crank shape, and the flow velocity of the blow-by gas flowing through the blow-by gas flow path 31 decreases such that more oil is separated from the blow-by gas.

The height (the length) of the blow-by gas flow path 30 is twice or more than the diameter of a cylinder 25, and the height of the blow-by gas flow path 31 is four times or more than the diameter of a cylinder 25. However, it is sufficient that the height (the length) of each of the blow-by gas flow paths 30 and 31 is at least once or more the diameter of a cylinder 25, that is, it is sufficient that the height (the length) is greater than the diameter of a cylinder 25. This makes it possible to secure a minimum period of time to separate the oil from the blow-by gas in each of the blow-by gas flow paths 30 and 31. The height (length) of the blow-by gas flow path 30 and the height (length) of the blow-by gas flow path 31 may be equal or substantially equal to each other.

Furthermore, the breather chamber 24 is attached to the cylinder block 20 in the engine 14 described above. However, the breather chamber 24 may be attached to the cylinder head 21. Alternatively, the breather chamber 24 and the cylinder head 21 may be integral.

The cylinder block 20 includes the two blow-by gas flow paths 30 and 31, but may include three or more blow-by gas flow paths. In this case, at least one blow-by gas flow path is provided on each of the exhaust side and the intake side of the cylinder block 20.

In a preferred embodiment of the present invention, the engine 14 is an inline engine in which all four cylinders 25 are arranged along a single straight line. However, the present invention may also be applied to a V-type engine or a horizontally opposed type engine. In this case, the cylinder block of each bank includes at least two blow-by gas flow paths. Preferred embodiments of the present invention may also be applied to a single-cylinder engine.

Furthermore, the engine 14 is mounted on the outboard motor 12 in a preferred embodiment of the present invention. However, the present invention may also be applied to an engine of an inboard motor or an inboard/outboard motor. Regardless of the outboard motor, the inboard motor, or the inboard/outboard motor, the axial direction of the crankshaft of the engine does not need to be perpendicular or substantially perpendicular to the bottom of the hull. For example, the axial direction of the crankshaft of the engine may be horizontal or substantially horizontal to the bottom of the hull.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor to be attached to a hull of a marine vessel, the outboard motor comprising: an internal combustion engine including a cylinder block including at least one cylinder; wherein the cylinder block includes two blow-by gas flow paths to guide blow-by gas from a crank chamber to a breather chamber; the internal combustion engine is oriented such that a crankshaft extends along a direction perpendicular or substantially perpendicular to a bottom of the hull when the marine vessel is sailing; each of the two blow-by gas flow paths extends from the crank chamber to the breather chamber such that the two blow-by gas paths do not join together between the crank chamber and the breather chamber; and at least one of the blow-by gas flow paths extends parallel or substantially parallel to the crankshaft.

2. The outboard motor according to claim 1, wherein the two blow-by gas flow paths sandwich the at least one cylinder therebetween.

3. The outboard motor according to claim 1, wherein the cylinder block includes a plurality of cylinders arranged along a straight line;

at least one of the blow-by gas flow paths extends along an arrangement direction of at least two cylinders out of the plurality of cylinders; and a length of the at least one of the blow-by gas flow paths along the arrangement direction is greater than a diameter of a cylinder.

4. The outboard motor according to claim 3, wherein the length along the arrangement direction of the at least one of the blow-by gas flow paths is greater than a length of a front end to a rear end of the at least two cylinders in the arrangement direction.

5. The outboard motor according to claim 1, wherein a length of one of the two blow-by gas flow paths is different from a length of the other of the two blow-by gas flow paths.

6. The outboard motor according to claim 1, wherein at least a portion of a boss surrounding at least one of the blow-by gas flow paths protrudes into the crank chamber.

7. An internal combustion engine to be attached to a hull of a marine vessel, the internal combustion engine comprising: a cylinder block including at least one cylinder and two blow-by gas flow paths to guide blow-by gas from a crank chamber to a breather chamber; wherein each of the two blow-by gas flow paths extends from the crank chamber to the breather chamber such that the two blow-by gas paths do not join together between the crank chamber and the breather chamber; the internal combustion engine is oriented such that a crankshaft extends along a direction perpendicular or substantially perpendicular to a bottom of a hull of the marine vessel when the marine vessel is sailing; and at least one of the blow-by gas flow paths extends parallel or substantially parallel to the crankshaft of the internal combustion engine.

8. A marine vessel equipped with an outboard motor, the outboard motor comprising: an internal combustion engine including a cylinder block including at least one cylinder; wherein the cylinder block includes two blow-by gas flow paths to guide blow-by gas from a crank chamber to a breather chamber; the internal combustion engine is oriented such that a crankshaft extends along a direction perpendicular or substantially perpendicular to a bottom of a hull of the marine vessel when the marine vessel is sailing; each of the two blow-by gas flow paths extends from the crank chamber to the breather chamber such that the two blow-by gas paths do not join together between the crank chamber and the breather chamber; and at least one of the blow-by gas flow paths extends parallel or substantially parallel to the crankshaft.

9. An outboard motor comprising:

the internal combustion engine according to claim 7.

10. A marine vessel comprising:

the internal combustion engine according to claim 7.

* * * * *